US006123471A

United States Patent [19]

Harb et al.

[11] Patent Number: 6,123,471

[45] Date of Patent: Sep. 26, 2000

[54] MEDIUM TRACKING BAR

[75] Inventors: Douglas L. Harb, Woodland Hills; Thomas M. Zevin, Canoga Park; Alexander Peter, Van Nuys, all of Calif.

[73] Assignee: Eltron International, Inc., Camarillo, Calif.

[21] Appl. No.: 09/392,818

[22] Filed: Sep. 9, 1999

Related U.S. Application Data

[60] Provisional application No. 60/106,892, Nov. 3, 1998.

[51] Int. Cl.[7] ..... B41J 35/04

[52] U.S. Cl. ..... 400/248; 400/234

[58] Field of Search ..... 400/248, 246, 400/234, 642, 613, 120.01, 247, 208, 208.1, 196

[56] References Cited

U.S. PATENT DOCUMENTS 4,084,683 4/1978 Moss ..... 400/248

5,342,131 8/1994 Nakajima et al. ..... 400/120.01

5,738,449 4/1998 Groswith, III et al. ..... 400/234

5,938,356 8/1999 Wirth et al. ..... 400/636.3

*Primary Examiner*—Christopher A. Bennett

*Attorney, Agent, or Firm*—Fulbright & Jaworski LLP

[57] ABSTRACT

A medium tracking bar is incorporated into an imaging device for preventing wrinkles or buckling of a medium strip sliding over and touching the medium tracking bar, the medium tracking bar being centrally pivoted to the imaging device by a connecting piece and being centrally pivoted by an elastic element to allow the medium tracking bar to swing like a teeter-totter board in any direction to counteract an uneven stress problem on the medium strip due to a misalignment of the medium strip and to realign the medium strip when it passes through the device thereby to prevent wrinkles or buckling of the medium strip.

20 Claims, 2 Drawing Sheets

MEDIUM TRACKING BAR

This application is based upon provisional patent application Ser. No. 60/106,892 which was filed in the United States Patent and Trademark Office on Nov. 3, 1998.

FIELD OF THE INVENTION

The present invention relates generally to a medium tracking bar adapted to be incorporated into a device for preventing wrinkles of a medium strip passing through the device, and more particularly to a ribbon tracking bar incorporated into a printer to prevent wrinkles from occurring in a ribbon strip used in the printer.

BACKGROUND OF THE INVENTION

Many conventional imaging devices, such as printers, use ribbons for transferring images onto printable media fed into the imaging devices. Typically, each of these printers has a print head to print images on the printable media, a platen to press the printable media against the print head and to move the printable media, and a ribbon mechanism to supply ribbons. The printable media, e.g., a label roll or a sheet of paper, and the ribbon are loaded between the platen and the print head. In an operational position, the platen presses the printable media and the ribbon tightly against the print head to form a contact area. Thus, when the platen rotates the printable media and the ribbon will be accordingly moved forward or backward depending on the rotational direction of the platen. The contact area defines a current printing location of the printable medium where images are to be formed thereon. After the print head prints images on the current contact area of the printable medium, the platen rotates to move the printable medium, together with the ribbon, forward toward a front side of the printer in order to position a subsequent contact area of the printable medium for printing. The platen is normally driven by a motor incorporated within the printer to control a rotational speed of the platen and, thus, to control the speed of the printable media and the ribbon moving past the print head.

All ribbons contain image forming materials, such as carbon particles, to be transferred, e.g., by thermal transfer methods, as images onto the printable media. They are often in the form of a ribbon strip wrapped to form a ribbon roll to be mounted on the ribbon mechanism of the printer. Ordinarily, only one side of the ribbon strip has the image forming materials deposited thereon. If, for any reason, the ribbon strip wrinkles during operation, the image forming materials within folds of such wrinkles cannot be properly transferred onto the printable media. Therefore, great effort has been taken by every conventional printer manufacturer to prevent wrinkles of the ribbon strip. Otherwise, if any wrinkle of the ribbon strip occurs, it will often cause errors or distortions of the images to be printed on the printable media, and perhaps a whole section of the printable media will be left blank.

Most commercially available ribbons are essentially in a form of a very thin web. Due to this thinness, it is very easy for a ribbon strip to wrinkle or to buckle when it passes through the printer. Alignment of the ribbon strip, as it passes through a ribbon path in the printer, is, therefore, critical to prevent wrinkles of the ribbon strip. As a result, most conventional printers use various techniques to align their ribbon strips when the ribbon strips pass through their respective ribbon paths. For example, some printers use ribbon edge guides to confine their ribbon strips within predetermined pathways of the printers while others use mechanisms to impart tension on the ribbon strips to prevent wrinkles. Nevertheless, these techniques are sometimes not very effective for eliminating the ribbon wrinkles that commonly occur to the ribbon strips during operation.

Part of the reason that the above-mentioned conventional techniques are not very effective in preventing wrinkles of the ribbon strips is that the ribbon strips are often over constrained or under-constrained in the printers. For example, if the ribbon strip is not perfectly aligned by the printer, uneven stress will be imparted to various portions of the ribbon strip when the ribbon strip is moved from a supply roll mounted on the ribbon mechanism toward the print head and, thereafter, toward a take-up roll. The existence of the uneven stress on the ribbon strip is due to the fact that, when the ribbon strip is unaligned or tilted, the printer will pull a first part of the ribbon strip with a stronger tension than it pulls a second part of the ribbon strip. For example, if the ribbon strip is misaligned with the platen, the platen may pull a first end of the ribbon strip with a stronger tension than it pulls a second end, opposite to the first, of the ribbon strip. Moreover, when the ribbon strip is misaligned, the first part of the ribbon strip may be moved by the printer instantaneously faster than the second part moved by the printer. The first part of the ribbon strip thus has a different tension than that of the second part, and wrinkles will almost inevitably occur in the ribbon strip due to the tension difference. Once wrinkles occur, the thin-web nature of the ribbon strip also promotes the wrinkles to further accumulate or transmit. Thus, an event that starts with a small uneven stress on the ribbon strip due to a slight misalignment may cause the ribbon strip to twist and propagate the twisting to eventually corrupt the printing.

Many conventional printers have insufficient mechanisms to resolve the above-mentioned, alignment induced, uneven stress problem. Often, they simply provide ribbon guides in the printers or apply pulling and/or dragging forces on the ribbon strips in the hope of preventing wrinkles. Furthermore, once the uneven stress occurs to the ribbon strip, a conventional printer cannot realign the ribbon strip in real time to prevent wrinkles before the ribbon strip reaches the print head. For a conventional printer, the ribbon strip can only be readjusted after the problem of wrinkles has been noted by a user. This post problem correction disrupts the printing process, wastes and/or damages printable media, takes operator time, and is a corrective, rather than a preventive, measure.

SUMMARY OF THE INVENTION

An object of the present invention is to provide a medium tracking bar incorporated into a device for preventing wrinkles and/or buckling of a medium strip sliding over and touching the medium tracking bar. The object is met by providing a medium tracking bar incorporated into a ribbon mechanism of a printer according to the present invention, as indicated in the claims.

Accordingly, one embodiment of the present invention provides the medium tracking bar to be incorporated into the printer in order to even a tension on the part of a ribbon strip extending out of a ribbon supply roll toward a print head of the printer. The medium tracking bar is positioned at the back side of the ribbon mechanism near the ribbon supply roll, and is centrally pivoted to the ribbon mechanism.

The foregoing and additional features and advantages of the present invention will become apparent by way of non-limitative examples shown in the accompanying drawings and detailed descriptions that follow. In the figures and written descriptions, numerals indicate the various features of the invention, like numerals referring to like features throughout for both the drawing figures and the written descriptions.

DETAILED DESCRIPTION OF THE INVENTION

Figure 1:
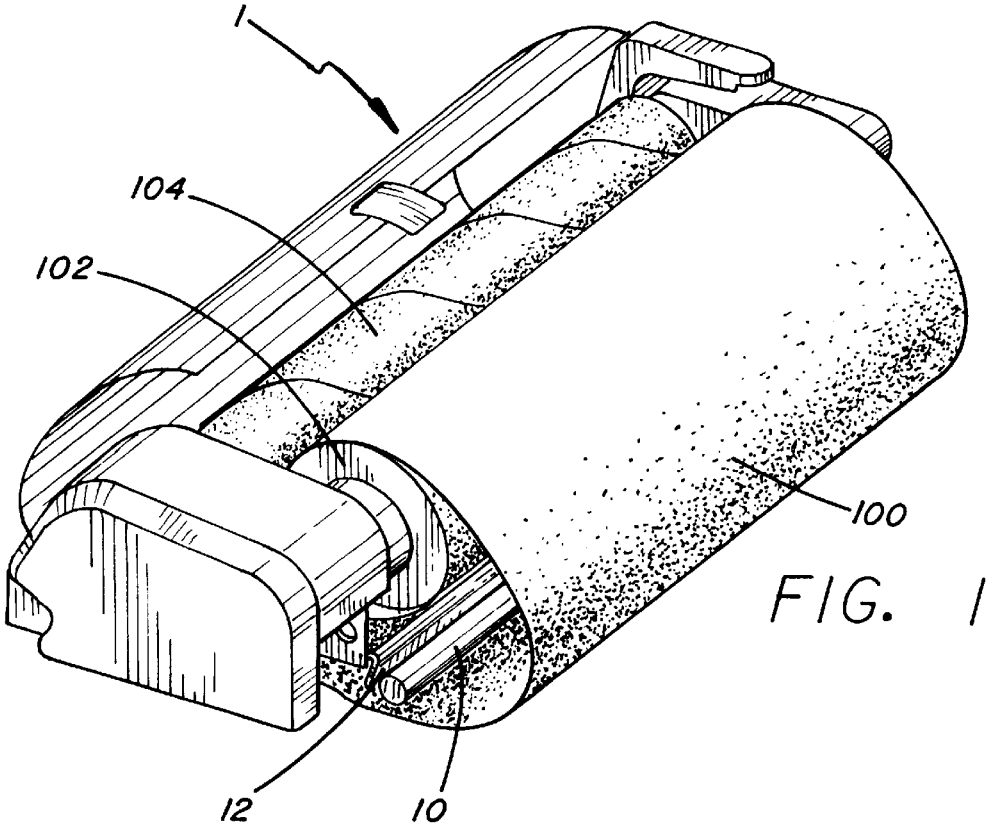
FIG. 1 shows a ribbon mechanism having a medium tracking bar with a ribbon supply roll mounted on the ribbon mechanism according to the present invention.
Figure 4:
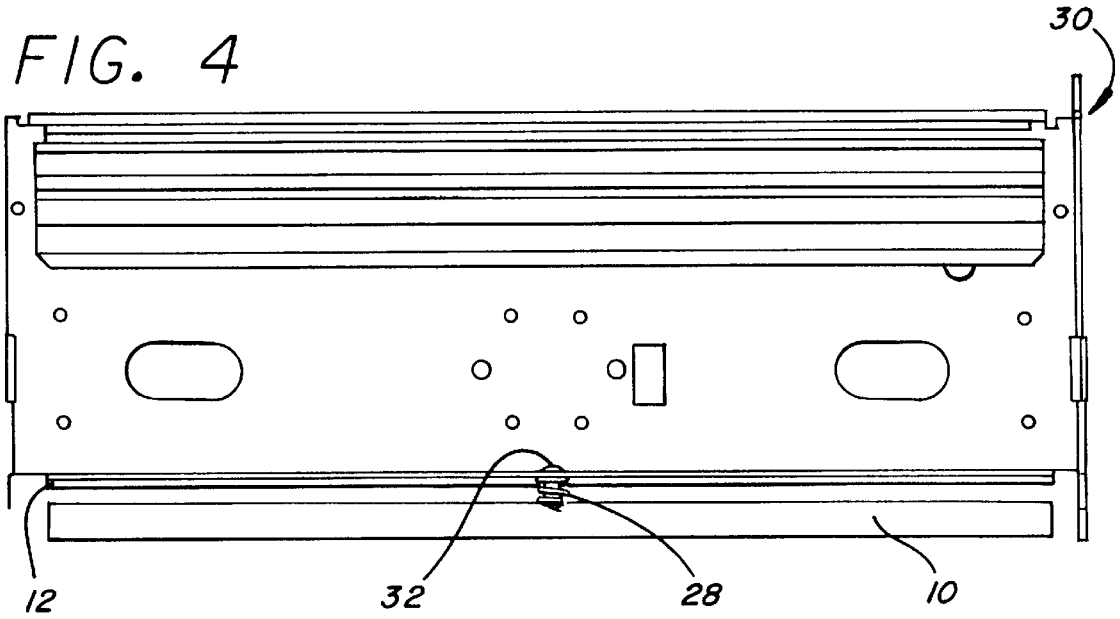
FIG. 4 shows a bottom view of the ribbon mechanism with the medium tracking bar mounted thereon according to the present invention.
Figure 5:
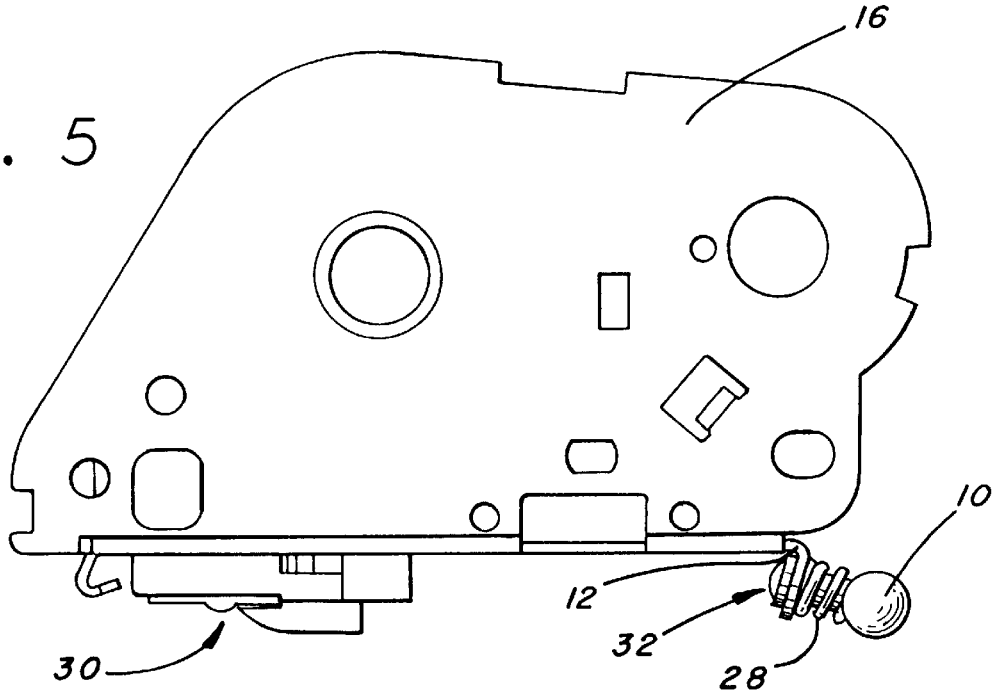
FIG. 5 shows a side view of the ribbon mechanism having the medium tracking bar mounted to the ribbon mechanism by a spring and a screw to a flange of the ribbon mechanism.

In a preferred embodiment, as shown in FIG. 1, the present invention provides a medium tracking bar 10 mounted on a ribbon mechanism 1 of an imaging device (not shown), such as a printer. The printer normally also includes a print head 30, FIG. 4 and 5, and a platen (not shown). The ribbon mechanism 1 defines a ribbon path of the printer. The print head 30 is coupled underneath to the ribbon mechanism 1, as shown in FIG. 4 and 5. In one embodiment, the print head 30 is coupled to the ribbon mechanism 1 by a compliant means (not shown). Thus, the print head 30 may be slightly tilted when it presses against the platen. In yet another embodiment, the print head 30 may be fully and rigidly integrated onto the ribbon mechanism 1. FIG. 1 also shows that a ribbon supply roll 102 is mounted on and near a back side of the ribbon mechanism 1. When the printer operates, the ribbon strip 100 of the ribbon supply roll 102 will be pulled by the platen toward the back side of the ribbon mechanism 1 and then over, behind and underneath the medium tracking bar 10. The ribbon strip 100 then proceeds underneath the ribbon mechanism 1 toward a front side of the ribbon mechanism 1. Thereafter, the ribbon strip 100 is pulled up by a take-up reel 104 mounted on the ribbon mechanism 1 to be wrapped around the take-up reel 104. As a result, the ribbon strip 100 is fed between the print head 30 and the platen to allow printing.

Figure 2:
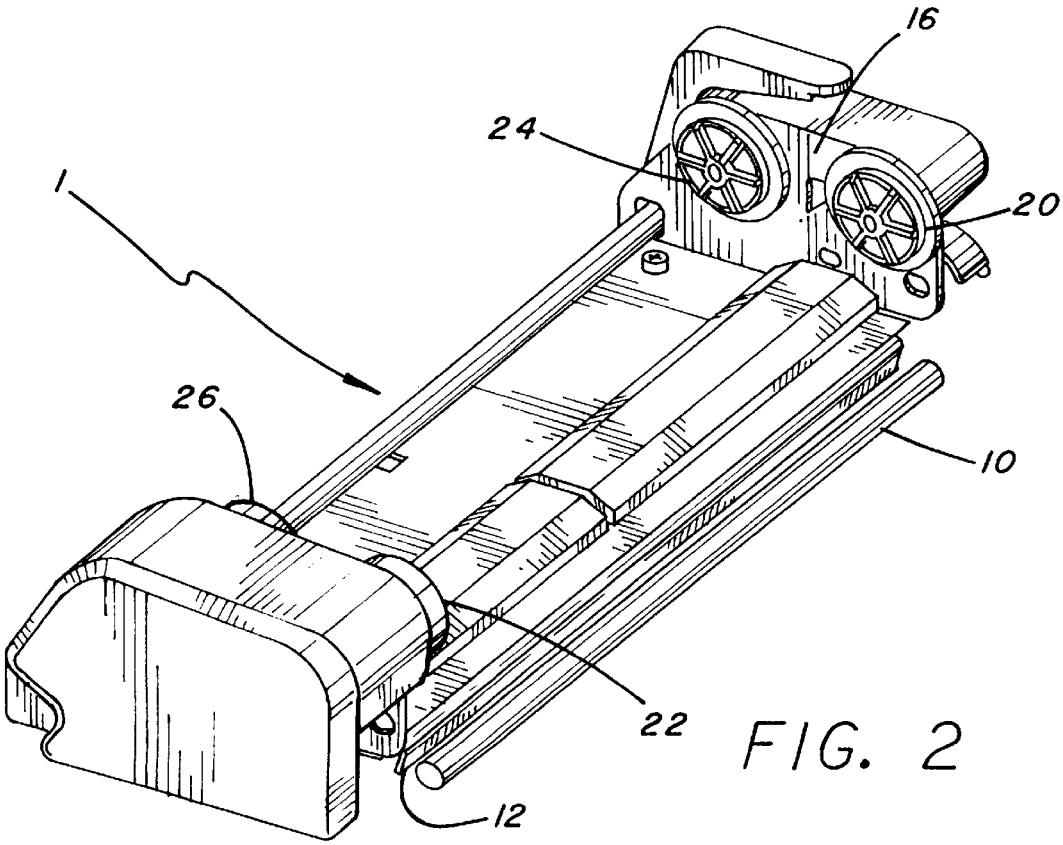
FIG. 2 shows the ribbon mechanism and the medium tracking bar of the present invention.

As shown in FIGS. 1 and 2, the medium tracking bar 10 is mounted at the back side of the ribbon mechanism 1. In the preferred embodiment, the ribbon mechanism 1 has a pair of supply spindles 20 and 22 positioned at opposite sides of a frame 16 of the ribbon mechanism 1 near the back side, and a pair of take-up spindles 24 and 26 positioned at opposite sides of the frame 16 of the ribbon mechanism 1 near the front side. The ribbon supply roll 102 is mounted to the supply spindles 20 and 22, and the take-up reel 104 is mounted to the take-up spindles 24 and 26. The supply spindles 20 and/or 22 may be coupled to a first clutch mechanism (not shown) to impart tension to the ribbon strip 100. Likewise, the take-up spindles 24 and/or 26 may be coupled to a second clutch mechanism (not shown) to impart tension to the ribbon strip 100 as well. In another embodiment, a shaft tensioner means, which has a built-in clutch mechanism, may be used to replace the supply spindles 20 and 22 and/or the take-up spindles 24 and 26 for mounting the ribbon supply roll 102 and for providing tension to the ribbon strip 100.

In the preferred embodiment, the medium tracking bar 10 is mounted to a V-shape metal flange 12, which, in turn, is mounted to the ribbon mechanism 1 at the back side, as shown in FIG. 1 and 2. The metal flange 12 has a first V-portion fixedly secured to a surface of the ribbon mechanism I and a second V-portion extending downward, and slightly forward, form the bottom of the ribbon mechanism 1. As shown in FIG. 4, the second V-portion of the metal flange 12 has a centrally located hole suitable for a screw 32 to pass through. The downward length of the second V-portion of the metal flange 12 shall not extend downward beyond the assembled medium tracking bar 10, FIG. 5. Thus, the ribbon strip 100 will not touch the second V-portion of the metal flange 12 when the ribbon strip 100 moves around the medium tracking bar 10 and underneath the ribbon mechanism 1.

In another embodiment of the invention, the V-shape metal flange 12 may be formed by extending the base surface of the ribbon mechanism 1 at the back side downward and slightly forward toward the bottom of the ribbon mechanism 1. In addition, the V-shape flange 12 may also be made of any other suitable material.

Figure 3:
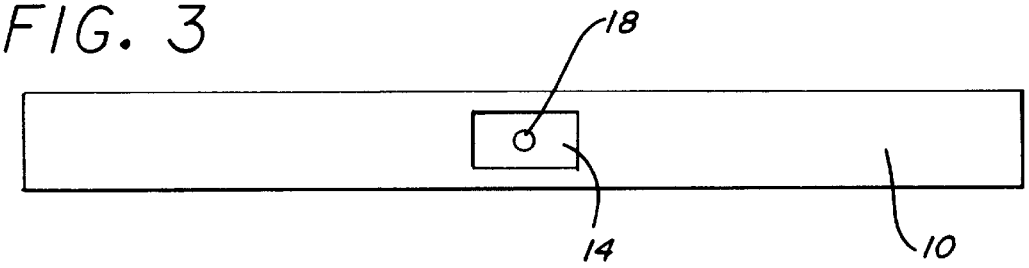
FIG. 3 shows the medium tracking bar according to the present invention.

The medium tracking bar 10, as shown in FIG. 3, is cylindrically shaped, approximately 9 inches long and has a rectangular recess 14 at the center of one side. The V-shape metal flange 12 has about the same length as that of the medium tracking bar 10. At the center of the square recess 14 of the medium tracking bar 10, there is a threaded hole 18 that is suitable for the screw 32 to be screwed therein. FIG. 4 shows the medium tracking bar 10 being mounted on the V-shape flange 12 by the screw 32 and a compression spring 28. The recess 14 has a width greater than the diameter of the compression spring 28 to enclose a first end of the compression spring 28 completely. Moreover, the bottom of the recess 14 is flat such that the compression spring 28 will urge the medium tracking bar 10 evenly outward when it is mounted on the recess 14. As stated, the V-shape metal flange 12 is secured to the ribbon mechanism 1, thus the medium tracking bar 10 is mounted on the ribbon mechanism 1 through the V-shape metal flange 12.

The screw 32 and the compression spring 28 act together as a central pivot to the medium tracking bar 10. After the medium tracking bar 10 is mounted to the ribbon mechanism 1, the distance between the medium tracking bar 10 and the V-shape metal flange 12, measured from the center surface of the medium tracking bar 10 that is adjacent to the compression spring 28 and facing the ribbon mechanism 1 to the metal flange 12, is approximately between 0.25 and 0.4 inches. By centrally pivoting to the ribbon mechanism 1, the medium tracking bar 10 may swing vertically and/or horizontally, or in any combination of directions thereof, like a teeter-totter board mounted on a spring. Moreover, when it is mounted and before the ribbon strip 100 is sliding against it, the medium tracking bar 10 should be capable of assuming a balanced position, which is substantially level to the base surface of the ribbon mechanism 1 and is approximately parallel to the V-shape metal flange 12.

The compression spring 28 provides a force that resists against pulling in and/or pushing away the medium tracking bar 10 from its balanced position. This resisting force is useful to counteract the uneven stress imported to the ribbon strip 100 from the misalignment of the ribbon strip 100, as will be elaborated later. The resisting force also helps maintain the medium tracking bar 10 at its balanced position when no other external force is acting on the medium tracking bar 10. The resisting force magnitude is determined by the extent of the screw 32 threaded into the threaded hole in the medium tracking bar 10. The closer the separation distance between the medium tracking bar 10 and the V-shape metal flange 12, (i.e., being screwed together more tightly,) the stronger the resisting force will be due to a more compressed spring 28. As a result, the user may adjust the resisting force by screwing or unscrewing the medium tracking bar 10 with respect to the V-shape flange 12.

As shown in FIG. 1, the ribbon strip 100 wraps around the medium tracking bar 10 during operation of the printer. As mentioned, the thinness of the ribbon strip 100 makes it easy for the ribbon strip 100 to become misaligned during operation. Furthermore, assembly imperfection of the printer, however slight, will almost inevitably cause various parts of the printer to be slightly misaligned with respect to each other. When closed in the operational position, the print head 30 may also not perfectly align with the platen. As a result, any of the above reasons, inter alia, may potentially contribute to cause the ribbon strip 100 to misalign with the ribbon supply roll 102 after the ribbon strip 100 leaves the ribbon supply roll 102. Misalignments of the ribbon strip 100 will likely cause the ribbon strip 100 to wrinkle because a first end the ribbon strip 100 will be pulled with a slightly stronger force by the platen than a second end of the ribbon strip 100 is pulled by the platen. Thus, uneven stress in the ribbon strip 100 will occur if a misaligned ribbon strip 100 moves around the ribbon mechanism 1.

For example, consider a situation when the platen of the printer pulls the ribbon strip 100 toward the print head 30 and thus unrolls the ribbon supply roll 102 during printing. If the ribbon strip 100 is not perfectly aligned between the ribbon supply roll 102 and the print head 30, a first portion, e.g., at one end close to one of the spindles 20 or 22, of the ribbon strip 100 will be pulled by a higher tension than that of a second portion, e.g., at the opposite end close to the corresponding spindles 22 or 20. Moreover, the first portion may be moved instantaneously faster than the second portion moved by the printer. The uneven stress on different portions of the ribbon strip 100 thus will cause the ribbon strip 100 to wrinkle or to buckle. According to the present invention, the medium tracking bar 10 provides a unique way to counter the above-mentioned uneven stress problem, and thus to prevent wrinkles of the ribbon strip 100.

If the ribbon strip 100 is misaligned with respect to the ribbon mechanism 1, a first portion, e.g., the right end, of the ribbon strip 100 will have a higher tension than that of a second portion, e.g., the left end, (or vice-versa) of the ribbon strip 100 due to the misalignment. If the ribbon strip 100 moves unevenly from the ribbon supply roll 102 to the print head 30 by wrapping around the medium tracking bar 10, the tighter end of the ribbon strip 100 will pull a respective first end of the medium tracking bar 10 that touches this tighter end of the ribbon strip 100 toward, horizontally and/or vertically, the ribbon mechanism 1. Correspondingly, a second end, that is opposite to the first, of the medium tracking bar 10 that touches the looser end of the ribbon strip 100 will be pushed away, again vertically and/or horizontally, from the ribbon mechanism 1 like a teeter-totter board. By pulling inward the first end of the medium tracking bar 10 and urging outward the second end of the medium tracking bar 10, the medium tracking bar 10 helps the ribbon strip 100 realign before it reaches the print head 30.

Additionally, the teeter-totter action of the medium tracking bar 10 helps equalize the stress differences between the first and second portions of the ribbon strip 100. The equalization effect takes place due to the fact that the first portion of the ribbon strip 100, which has a higher tension, will now travel a slightly shorter distance between the ribbon roll and the platen as compared to a slightly longer distance traveled by the second portion of the ribbon strip 100, which has a lower tension. As a result, the second portion of the ribbon strip 100 will be stretched slightly and the tensions on the ribbon strip 100 will be equalized by the action of the medium tracking bar 10, and wrinkles will be less likely to occur in the ribbon strip 100. The above processes can be transient and the gimbaled nature of the medium tracking bar 10 can continuously adjust itself as conditions change.

From the foregoing, it will be appreciated that, although specific embodiments of the invention have been described herein for purposes of illustration, various modifications may be made by persons skilled in the art without deviating from the spirit and/or scope of the invention. For example, the medium tracking bar 10 may be made of any of a number of materials suitable for the purpose of the present invention. The medium tracking bar 10 may also be used in conjunction with any other device, e.g., a fax machine, to realign a medium strip, or to redress an uneven stress problem of the medium strip in that device, or to prevent wrinkles of the medium strip in passing through the device. The screw and the compression spring noted-above may also be replaced by other suitable means for a central pivot according to the principle of the present invention. The compression spring may be carefully chosen from one of many commercially available springs or be replaced by other types of elastic means to provide suitable resisting force for the medium tracking bar according to any particular needs of a device. Furthermore, the dimensions of various parts of the invention may be changed to accommodate different devices.

What is claimed is:

1. A tension balancing device adapted to balance uneven stresses in a medium strip, the tension balancing device comprising:

a tracking bar adapted to allow the medium strip to slide over said tracking bar; and a pivot means, said pivot means being loosely pivotally coupled to said tracking bar to allow the tracking bar to simultaneously translate and pivot with respect to the pivot means to even the stress on the medium strip.

2. The tension balancing device of claim 1, wherein said tracking bar is at least partially cylindrically shaped and is coupled to the imaging device by said pivot means at a predetermined location of said tracking bar.

3. The tension balancing device of claim 1, wherein said pivot means comprises:

a fixing means adapted to couple said tracking bar to an imaging device; and an elastic means coupled to said pivot means to press against said tracking bar to resiliently urge the tracking bar against the medium strip for balancing the uneven stress experienced by the medium strip when the medium strip when the medium strip slides over said tracking bar.

4. The tension balancing device of claim 3, wherein said fixing means comprises a screw adapted to screw into and pass through respective screw holes of said tracking bar and the imaging device.

5. The tension balancing device of claim 4, wherein said elastic means comprises a compression spring, said compression spring encircling said fixing means and urging said tracking bar outwardly.

6. A medium tension balancing system adapted to be incorporated into an imaging device, comprising:

a medium support mechanism, said medium support mechanism being adapted to support a medium roll mounted thereon; and a tension balancing means coupled to said medium support mechanism, said tension balancing means comprising a tracking bar adapted to allow the medium strip to slide over said tracking bar; and a pivot means, said pivot means being loosely pivotally coupled to said tracking bar to allow the tracking bar to simultaneously translate and pivot with respect to the pivot means to even the stress on the medium strip.

7. The medium tension balancing system of claim 6, wherein said first medium support means comprises first and second medium support spools respectively secured to opposite ends of said medium frame to support the medium roll.

8. The medium tension balancing system of claim 7, further comprising a torsion mechanism coupled to said first or second, or both, medium support spools, said torsion mechanism, when mounted, resisting rotation of said first or second medium support spools in a rotational direction to impart tension on the medium strip of the medium roll.

9. The medium tension balancing system of claim 6, wherein said first medium support means comprises a medium support shaft coupled to said medium frame at opposite ends to support the medium roll.

10. The medium tension balancing system of claim 9, wherein said medium support shaft comprises a torsion mechanism adapted to resist rotation of said medium shaft in a rotational direction to impart tension on the medium strip of the medium roll.

11. The medium tension balancing system of claim 6, further comprising a second medium support means coupled to said medium frame at opposite ends for wrapping the medium strip around a medium take-up roll mounted on said second medium support means after the medium strip has moved past said tension balancing means.

12. The medium tension balancing system of claim 11, wherein said second medium support means comprises first and second medium take-up spools adapted to receive the medium take-up roll for wrapping the medium strip around the medium take-up roll.

13. The medium tension balancing system of claim 12, further comprising a gearing mechanism coupled to the first or second medium take-up spools, said gearing mechanism being adapted to be coupled to a motor of the imaging device for rotating the first or second medium take-up spools.

14. The medium tension balancing system of claim 11, wherein said second medium support means comprises a medium take-up shaft coupled to the medium frame at opposite ends and adapted to mount the medium take-up roll thereon.

15. The medium tension balancing system of claim 14, further comprising a gearing mechanism coupled to the medium take-up shaft at one end, said gearing mechanism being adapted to be coupled to the motor of the imaging device for rotating the medium take-up shaft.

16. The medium tension balancing system of claim 6, wherein said tension balancing means comprises:

a medium tracking bar, said medium tracking bar being adapted to allow the medium strip to slide over said medium tracking bar; and a pivot means, said pivot means pivotally coupling said medium tracking bar and the imaging device at opposite ends, thereby said medium tracking bar being adapted to be pivotally movable, vertically and/or horizontally, with respect to the medium support mechanism to even the stress on the medium strip and to align the medium strip in the imaging device.

17. The medium tension balancing system of claim 6, wherein said medium tracking bar is at least partially cylindrically shaped and is coupled to the imaging device by said pivot means at a predetermined location of said medium tracking bar.

18. The medium tension balancing system of claim 6, wherein said pivot means comprises:

a connecting means adapted to couple said medium tracking bar and the medium support mechanism; and an elastic means coupled to said pivot means to press against said tracking bar to resiliently urge the tracking bar against the medium strip for balancing the uneven stress experienced by the medium strip when the medium strip when the medium strip slides over said tracking bar.

19. The medium tension balancing system of claim 18, wherein said connecting means comprises a screw adapted to screw into and pass through respective screw holes of said medium tracking bar and the medium support mechanism.

20. The medium tension balancing system of claim 18, wherein said elastic means comprises a compression spring, said compression spring encircling said connecting means and urging said medium tracking bar outwardly.

* * * * *

UNITED STATES PATENT AND TRADEMARK OFFICE

CERTIFICATE OF CORRECTION

PATENT NO. : 6,123,471

DATED : September 26,2000

INVENTOR(S) : Douglas Harb, et al.

It is certified that error appears in the above-identified patent and that said Letters Patent is hereby corrected as shown below:

| Column | Line | |
|---|---|---|
| 6 | 48 | Change "the" to - - a - -. |
| 8 | 37 | Delete "when the medium strip." |

Signed and Sealed this

Fifteenth Day of May, 2001

*Attest:*

Nicholas P. Godici

NICHOLAS P. GODICI

*Attesting Officer*

*Acting Director of the United States Patent and Trademark Office*